US005137096A

United States Patent [19]

Druesdow

[11] Patent Number: 5,137,096

[45] Date of Patent: Aug. 11, 1992

[54] DUST BOOT AND PROTECTIVE SHROUD FOR IMPACT HAMMER

[75] Inventor: Charles L. Druesdow, North Olmsted, Ohio

[73] Assignee: Allied Steel & Tractor Products, Inc., Solon, Ohio

[21] Appl. No.: 763,330

[22] Filed: Sep. 20, 1991

[51] Int. Cl.[5] ..... B25D 17/00

[52] U.S. Cl. ..... 173/171; 173/DIG. 2; 175/414; 74/608; 181/230

[58] Field of Search ..... 173/171, DIG. 2; 175/414; 74/608; 181/230; 408/67

[56] References Cited

U.S. PATENT DOCUMENTS

| | | | |
|---|---|---|---|
| 2,685,874 | 8/1954 | Ford | 74/608 |
| 2,944,523 | 9/1957 | Werstein . | |
| 3,936,213 | 2/1976 | Kappel | 408/67 |
| 3,975,918 | 8/1976 | Jansz | 173/DIG. 2 |
| 4,274,258 | 6/1981 | Shirai et al. | 181/230 |
| 4,664,394 | 5/1987 | Theissig et al. | 74/608 |
| 5,016,802 | 5/1991 | Haytayan | 173/DIG. 2 |

FOREIGN PATENT DOCUMENTS 77382 5/1933 Sweden .

2237528 5/1991 United Kingdom .

*Primary Examiner*—Frank T. Yost
*Assistant Examiner*—Scott A. Smith
*Attorney, Agent, or Firm*—Watts, Hoffmann, Fisher & Heinke

[57] ABSTRACT

A flexible metal dust boot, comprising a bellows, and a surrounding protective shroud capable of withstanding high temperatures. The boot and shroud are mounted on a support plate, which can be conveniently attached to the body of a reciprocatable hydraulic or pneumatic hammer. The boot and shroud extend from the bottom of the hammer body, in surrounding relationship to the tool. The support plate forms a seal against the bottom surface of the hammer body. The bellows is attached to the plate at one end, and to the tool, in fluid tight relationship, at the other end. An air fitting in the bellows structure facilitates connection to a pressurized air source to inhibit the entry of particulate matter as well as fluids in the hammer is submerged in use. During hammer operation, the bellows reciprocates with the tool. The shroud surrounds the bellows and extends the axial length of the bellows to shield the bellows from particulate matter generated during operation of the hammer.

22 Claims, 2 Drawing Sheets

DUST BOOT AND PROTECTIVE SHROUD FOR IMPACT HAMMER

FIELD OF INVENTION

This invention relates to a dust boot and protective shroud for boom-supported impact hammers to protect the hammer mechanisms from particulate matter and debris in use.

BACKGROUND ART

Impact hammers utilize a chisel-like tool for breaking hard materials. The tool is supported in a bushing or bushings for relative sliding movement. An end of the tool opposite the working end is impacted by a piston, directly or through an anvil, the piston being reciprocated within a cylinder and powered by air or hydraulic fluid. The stroke of the tool is relatively short, perhaps 1 to 2 inches. The hammer is typically attached to the end of a boom by which the hammer is moved and positioned against material to be chipped or broken.

The environment in which impact hammers are used is inimical to long wear of the hammer mechanism. Due to high forces and relatively high frequencies of impact, abrasive duct and debris from the material being broken or chipped are scattered with substantial force and velocity. The nature and construction of the hammer mechanism requires that the tool-supporting bushing or bushings be located near the work and therefore they are directly exposed to the abrasive dust and debris. These harsh materials are carried or work their way into the bushings by the reciprocating tool, and often work their way up into the cylinder itself and associated mechanisms. The abrasive nature of the dust and debris destroys the seals and bushings. This problem is particularly bad where the hammers are used in a horizontal or upward orientation, and when used in particularly harsh environments, such as in breaking up slag over molten metal, such as aluminum. Slag over molten aluminum tends to crumble and powder when impacted, and hot abrasive particles are projected upward and into the bushings, hammer mechanisms and seals. These and other corrosive substances with which the impact hammers may be used in industrial environments exacerbate the problems created by abrasive particles and dust, greatly shortening the life of the bushings, seals and other mechanisms, requiring frequent overhaul and replacement of parts.

Rubber dust caps for percussive hammers of the type used with masonry or the like are known (U.S. Pat. No. 2,944,523), as are flexible shields or boots for pile drivers or jackhammers to muffle the sound generated by their operation, and rubber-like safety attachments at the juncture of the tool and operating cylinder of hand-held pneumatic hammers, to protect the user in the event of a break in the tool shaft. See, for example, U.S. Pat. Nos. 2,685,874; 3,975,918; and Swedish Patent No. 77,382, dated May 23, 1933. These structures were not intended to and would not provide adequate protection to the seals and other working parts of the mechanism of a boom-supported impact hammer that is used in very hot and very harsh environments and that applies very high impact forces that cause shattered particles of hot and hard abrasive material to impinge against the hammer mechanism.

SUMMARY OF THE INVENTION

The present invention provides a flexible metal dust boot and a surrounding protective shroud mounted on a support plate, which as a unit, can be conveniently attached to the hammer body, housing plates, or mounting brackets that support and house the hammer mechanism. The boot and shroud extend from the bottom of the body or housing, in surrounding relationship to the tool. The plate forms an effective seal against the bottom surface of the hammer body or housing, while the flexible metal bellows is clamped in sealing relationship about the tool, the bellows being sufficiently flexible to reciprocate with the relatively short stroke of the chisel-like tool in use. The shroud surrounding the bellows is of relatively heavy metal, and extends the axial length of the bellows and serves along with a stepped sleeve at the bottom of the bellows to shield the bellows against contact with other objects or the material being worked upon during movement or adjustment of the hammer position, and against flying chips or other debris. All of the parts are of metal, suitable for resisting the high temperature to which the impact hammer may be subjected, as when used to break up slag over molten metal, a primary application for which the invention is particularly suited. To further inhibit entry of surrounding fluid (liquid or gas) as well as entrained particles, the interior volume of the bellows can be supplied with air or other gas under pressure greater than ambient.

Accordingly, the present invention provides a dust boot and shroud for use with a fluid actuated impact hammer or the like having a body and a reciprocatable tool extending from the body, the dust boot and shroud comprising a mounting structure adapted to be fixed to the body, a sleeve adapted to tightly surround the tool and to reciprocate with the tool when the hammer is in use, an expandable bellows interposed between and connected to the mounting structure and the sleeve, and a protective shroud connected to the mounting structure and surrounding the bellows in spaced relationship to protect the bellows against physical damage.

The invention further relates to the combination of a fluid actuated impact hammer having a body, a tool projecting from an end of the body, and a protective tubular bellows and shroud. The bellows is comprised of heat-resistant flexible metal. It is connected at one end to the end of the body and surrounds a portion of the projecting tool. The bellows is connected at its other end to the tool so as to expand and contract as the tool reciprocates. The bellows serves to protect the hammer from particulate matter generated when the hammer is used. An air fitting in the bellows structure facilitates connecting the bellows to a source of pressurized gas to create a pressure within the bellows greater than that of the ambient barometric pressure. Pressurizing the internal bellows volume not only inhibits the entry of particular matter into the bellows, but also surrounding fluids such as water if the hammer is submerged in use.

The shroud is constructed of heat-resistant and heavier metal than the bellows. It is connected to the housing, and surrounds at least a major portion of the bellows to shield the bellows against injurious impact. In the preferred embodiment, the bellows terminates at its distal end in a sleeve that is of heavier construction and that extends radially from the tool a distance at least equal to the major diameter of the bellows. The sleeve shields the bellows from direct impingement by flying particles of material being acted upon by the hammer that would otherwise enter the open end of the shroud. The sleeve also inhibits the entry of particles into an area between the shroud and bellows.

BEST MODE FOR PRACTICING THE INVENTION

Figure 1:
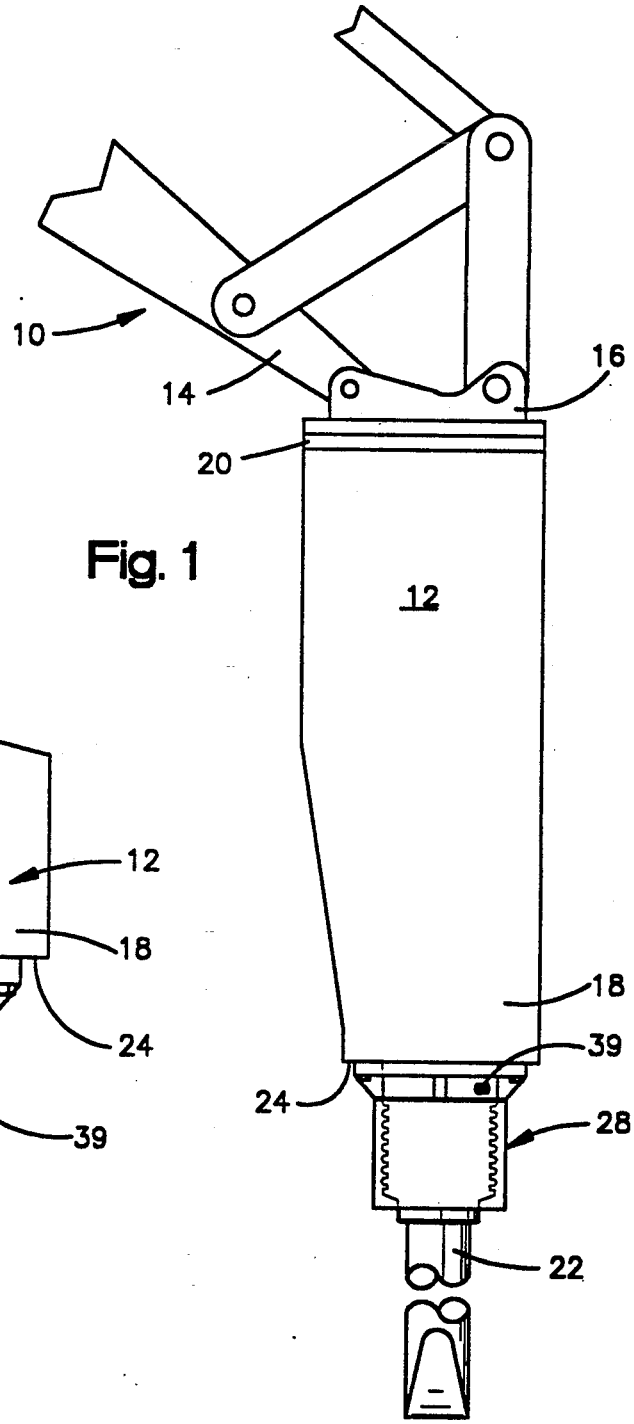
FIG. 1 is a side elevational view of a boom-mounted hydraulic impact hammer embodying the present invention.

With reference to the drawings, a typical heavy duty boom 10 is shown in FIG. 1, of the type that is mounted on a fixed or movable base (not shown). A hydraulic impact hammer 12 is attached to the end of the stick portion 14 of the boom in a conventional manner. The boom serves to position the hammer and apply the hammer against the material to be impacted. The hammer has an upper mounting bracket 16 attached to the top of the hammer body 20 and pivotally secured to the end of the boom. The body is a heavy-walled steel cylinder in which an hydraulically reciprocated piston moves to impact against an upper or inner end of a tool 22, which in the embodiment shown is a cross-cut chisel and which extends from the distal end (or bottom in the orientation shown) 24 of the housing 18. The chisel is supported for reciprocation relative to the body in a bushing 26. The construction is conventional and is exemplified by a boom-mounted hydraulic impact hammer manufactured and sold by Allied Steel & Tractor Products, Inc., of Solon, Ohio under the trademark HY-RAM. Hammers of this type are capable of delivering up to 10,000 foot-pounds of energy and producing 350 blows per minute in the largest models and lower energies but higher frequencies in smaller models.

Figure 2:
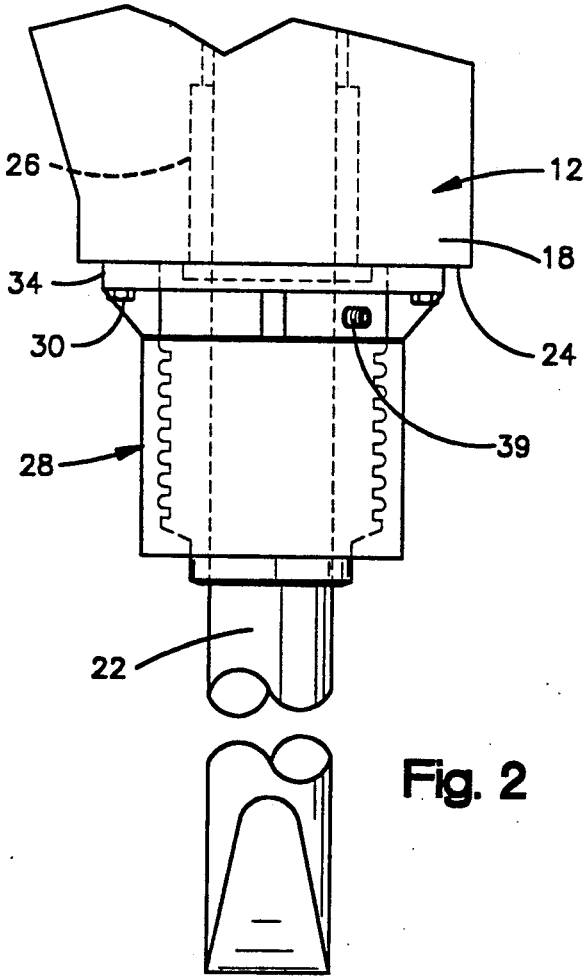
FIG. 2 is an enlarged partial side elevational view of the impact hammer of FIG. 1.
Figure 3:
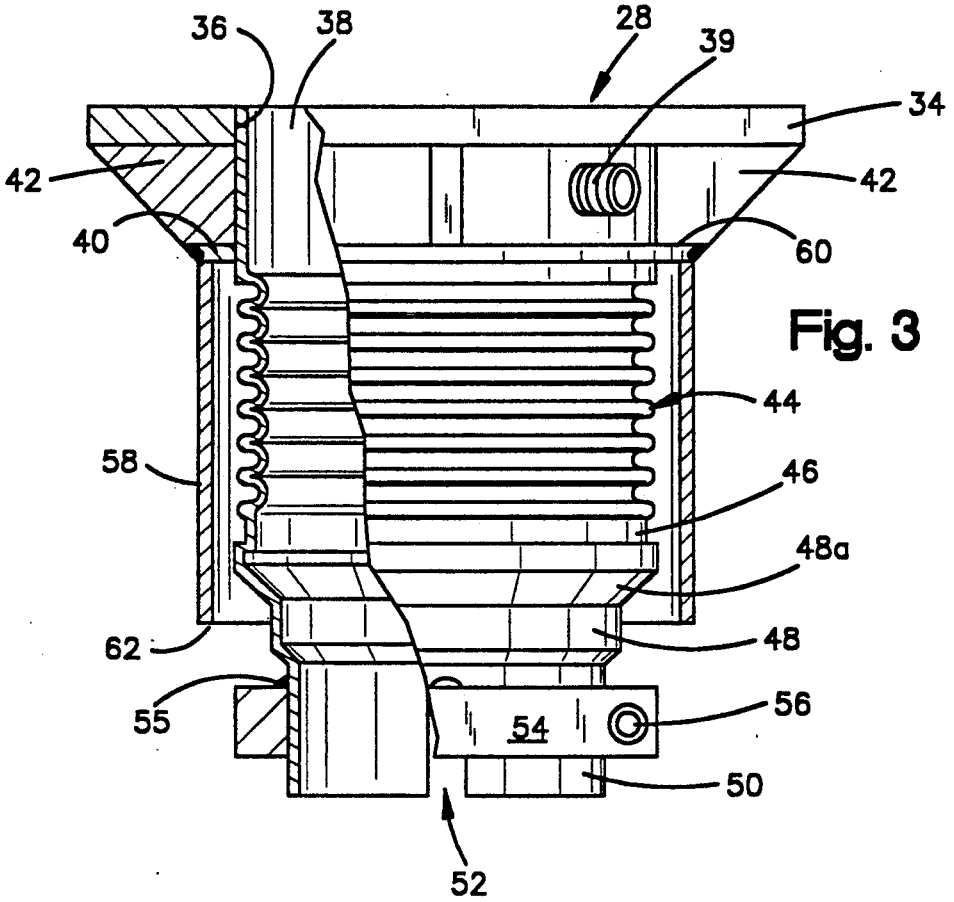
FIG. 3 is an enlarged view of the mounting plate, bellows, collar and surrounding shroud unit shown in FIG. 2, partially in elevation, partially in longitudinal section and with parts broken away.
Figure 4:
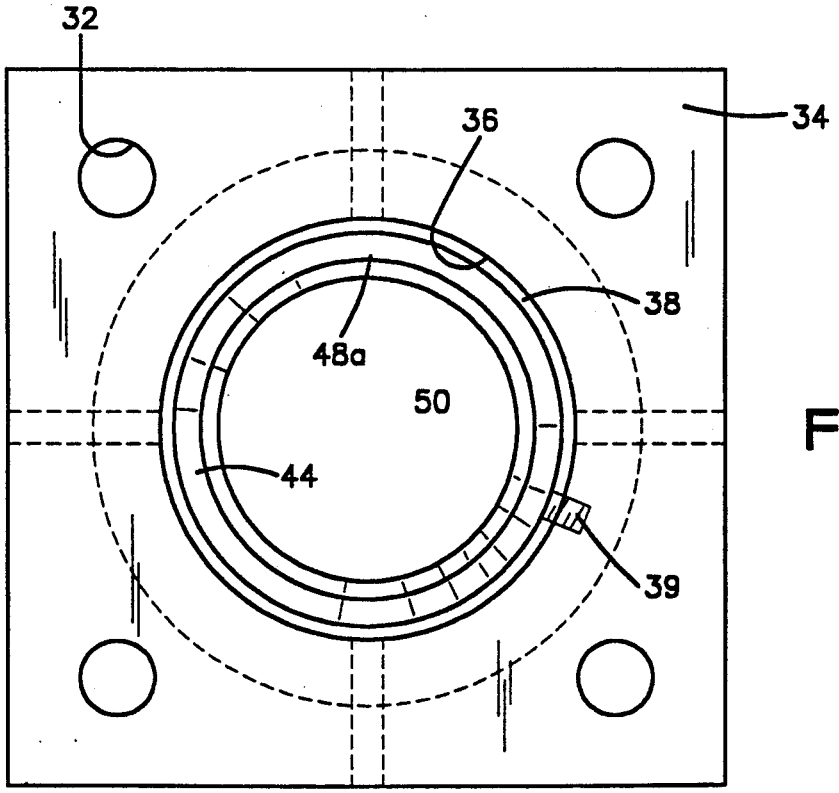
FIG. 4 is a top elevational view of the unit shown in FIG. 3.

As best shown in FIGS. 2–4, a protective bellows and shroud unit 28 is constructed for attachment to the bottom or distal end 24 of the hammer housing 18 by four machine screws 30 that extend through holes 32 in a top mounting plate 34 that directly abuts the bottom end 24 of the hammer body. The plate has a central circular opening 36 that receives the upper end of a tool collar tube 38 that extends axially downward in the orientation of FIG. 3 from the plate 34. Both the opening 36 and the collar tube are of a larger diameter than the tool 22. The collar tube and a surrounding circular flange 40 are reinforced with respect to the plate 34 by four gussets 42 that are welded to the collar tube, flange and plate. A tubular bellows 44 of thin, flexible, heat-resistant resistant metal extends from and is integral with the collar tube and has an inside diameter greater than that of the tool 22. The bellows is sufficiently long that it can readily expand and contract a sufficient distance longitudinally to accommodate the stroke of the tool 22. The distal or lower end 46 of the bellows is integral with a stepped sleeve 48 that terminates at a distal or lower end in a cylindrical cuff portion 50. The stepped sleeve is heavier and stronger than the bellows and includes a frusto-conical portion 48*a* that is of slightly larger diameter than the bellows and tapers inward in the direction away from the bellows, forming a protective deflecting surface directly beneath the bellows. The cuff portion 50 has one or more placket-like longitudinal slot or slots 52 by which the diameter of the cylindrical cuff can be modified by applying a hoop stress sufficient to slightly deform it. The cuff portion 50 has an inside diameter only slightly larger than the outside diameter of the tool 22 when the cuff is unstressed. A clamping collar 54 surrounds the cuff portion 50 and is welded to it at one spot 55, opposite a clamp screw 56 by which the cuff can be stressed to tightly clamp against the tool with sufficient force to prevent relative movement between the two and to provide a seal that prevents ingress of dust or other particles to the volume within the bellows. A threaded air fitting 39 extends from the exterior of the tool collar tube 38 and communicates through the collar tube to the interior of the bellows. The fitting 39 facilitates connection of an air hose (not shown) to supply air or another gas under greater than ambient pressure to the interior of the bellows to inhibit entry of fluids and entrained particles to the interior of the bellows through any small openings that may exist, e.g., through the cuff portion 50 if the clamping seal is not perfect.

A protective shroud 58, cylindrical in shape and of slightly larger inside diameter than the outside diameter of the bellows 44 and cuff 50 is welded at a top end 60 to the collar tube flange 40 and extends longitudinally downward from the flange and terminates at a bottom end 62 that is located slightly beyond, i.e., below in the orientation shown in the drawings, the bellows. The shroud is of heavier, i.e., thicker and stronger construction than the bellows to protect the relatively frangible bellows against impacts from objects such as materials being worked on by the hammer that might damage the bellows and destroy the integrity of the space sealed by the bellows and shroud unit. The entire unit 28 is preferably constructed of strong heat-resistant metal, such as steel, because the unit finds particular applicability on hammers used to break the slag formed over molten aluminum in aluminum-making processes. In the breaking up such slag, the hammer causes the slag to crumble and hot, abrasive, particles are projected upward and if they impinge against or settle on the bellows would damage it. The close surrounding proximity of the shroud to the bellows inhibits such contact and the somewhat heavier construction of the stepped sleeve 48, and especially the frusto-conical portion 48*a*, substantially blocks and deflects particles that might otherwise enter the bottom opening of the cylindrical shroud and prevents any that do enter from directly striking the bellows at high velocity.

While a preferred embodiment of the invention has been described with particularity, modifications or alterations may be made therein without departing from the spirit and scope of the invention set forth in the appended claims.

I claim:

1. A dust boot and shroud for use with a fluid actuated impact hammer or the like having a body and a reciprocatable tool extending from the body, the dust boot and shroud comprising a mounting structure adapted to be fixed to the body; an expandable bellows connected to the mounting structure at a first end portion, means to connect a second end of the bellows to the reciprocatable tool in fluid tight relationship, and a protective shroud connected to the mounting structure and surrounding the bellows in spaced relationship to protect the bellows against physical damage.

2. The device of claim 1 wherein the bellows is metal, elongated, tubular, longitudinally expandable and heat resistant.

3. The device of claim 1 wherein the means to connect the second end of the bellows includes a sleeve portion extending therefrom and wherein a shield of heavier construction than the bellows is connected to an extends radially of the sleeve.

4. The device of claim 3 wherein the sleeve portion has longitudinal slots to allow circumferential size adjustment.

5. The device of claim 3 wherein the shield of frustroconical in shape, increasing in diameter toward the bellows.

6. The device of claim 3 wherein the shroud is of heavier construction than the bellows and extends longitudinally beyond and surrounds the shield.

7. The device of claim 3 wherein said means includes a clamping collar surrounding the sleeve to clamp the sleeve tightly around the tool.

8. The device of claim 1 wherein the mounting structure comprises a mounting plate having a centrally located opening of diameter greater than the diameter of the tool, and a rigid cylindrical collar secured to the plate near the opening, extending axially and connected to the first end of the bellows.

9. The device of claim 8 wherein the cylindrical collar is supported by at least one gusset secured to the mounting plate and collar.

10. The device of claim 8 including a circular flange encircling and connected to the exterior of the cylindrical collar near the second end portion, and wherein a shroud is secured to the circular flange.

11. The device of claim 1 including means for communicating between the inside and outside of the dust boot for supplying gas to the bellows interior under greater than ambient pressure.

12. In combination, a fluid actuated impact hammer having a body, a tool projecting from an end of the body, and a protective tubular bellows and shroud, the bellows being of heat-resistant flexible metal connected at one end to said end of the body and surrounding a portion of the projecting tool, and connected at another end to the tool so as to expand and contract as the tool reciprocates and to protect the hammer from particulate matter generated when the hammer is used, and the shroud being of heavier heat-resistant construction that the bellows and connected to the housing and surrounding at least a major portion of the bellows to protect the bellows against injurious impact.

13. The device of claim 12 wherein the bellows includes a sleeve having longitudinal slots to allow circumferential size adjustment.

14. The device of claim 12 wherein the sleeve includes a shield portion of heavier construction than the bellows, the shield being connected to and extending radially of the sleeve.

15. The device of claim 12 wherein the shroud is metal and extends longitudinally beyond and surrounds the shield.

16. The device of claim 12 wherein the bellows-to-tool connection includes a clamping collar.

17. The device of claim 12 wherein the bellows-to-body connection includes a mounting structure, the mounting structure comprising a mounting plate having a centrally located opening and a cylindrical collar.

18. The device of claim 17 wherein a circular flange is connected about the exterior of the cylindrical collar and the shroud is secured to said flange.

19. The device of claim 12 including means for communicating between the inside and outside of the bellows for supplying gas to the bellows interior under greater than ambient pressure to protect the hammer from both fluid and particulate matter.

20. A dust boot and shroud for use with a fluid actuated impact hammer or the like having a body and a reciprocatable tool extending from the body, the dust boot and shroud comprising a mounting structure adapted to be fixed to the body, a sleeve adapted to tightly surround the tool and to reciprocate with the tool when hammer is in use, an expandable bellows interposed between and connected to the mounting structure and the sleeve, and a protective shroud connected to the mounting structure and surrounding the bellows in spaced relationship to protect the bellows against physical damage.

21. The device of claim 20 wherein the mounting structure comprised of a metal mounting plate and tubular collar having an external circular flange, the mounting plate having a centrally located aperture of diameter slightly greater than the diameter of the reciprocatable tool, said collar being secured adjacent said aperture and re-enforced by at least one gusset, and wherein the bellows is secured to the collar on one end and the shroud is connected to said flange.

22. The device of claim 20 including means for communicating between the inside and outside of the dust boot for supplying gas to the bellows interior under greater than ambient pressure.

* * * * *

UNITED STATES PATENT AND TRADEMARK OFFICE

CERTIFICATE OF CORRECTION

PATENT NO. : 5,137,096

DATED : August 11, 1992

INVENTOR(S) : Charles L. Druesedow

It is certified that error appears in the above-identified patent and that said Letters Patent is hereby corrected as shown below:

On the title page, item [75] Inventor:

The last name of the inventor is incorrectly spelled, delete "Druesdow" and replace with --Druesedow--.

Column 5, Claim 12, line 51, delete "that" and insert --than --

Signed and Sealed this

Nineteenth Day of October, 1993

Bruce Lehman

*Attest:*

BRUCE LEHMAN

*Attesting Officer*

*Commissioner of Patents and Trademarks*